US007132597B2

(12) United States Patent
Hosler

(10) Patent No.: US 7,132,597 B2
(45) Date of Patent: Nov. 7, 2006

(54) TRANSDUCER FOR CONVERTING BETWEEN MECHANICAL VIBRATION AND ELECTRICAL SIGNAL

(75) Inventor: David Lee Hosler, El Cajon, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 646 days.

(21) Appl. No.: 10/085,975

(22) Filed: Feb. 26, 2002

(65) Prior Publication Data

US 2003/0161493 A1 Aug. 28, 2003

(51) Int. Cl.
*G10H 3/00* (2006.01)

(52) U.S. Cl. ..... 84/723; 84/725; 84/730

(58) Field of Classification Search ..... None
See application file for complete search history.

(56) References Cited

U.S. PATENT DOCUMENTS 3,596,733 A * 8/1971 Bertagni ..... 381/431
3,725,561 A 4/1973 Paul
4,010,334 A 3/1977 Demeter
4,237,347 A 12/1980 Burundukov
4,314,495 A * 2/1982 Baggs ..... 84/731
4,504,932 A 3/1985 Sundt
4,520,238 A * 5/1985 Ikeda ..... 381/151
5,153,363 A * 10/1992 Fishman et al. ..... 84/731
5,204,487 A * 4/1993 Turner ..... 84/731
5,276,276 A 1/1994 Gunn
5,371,428 A * 12/1994 Kikuchi et al. ..... 310/324
5,461,193 A 10/1995 Schertler
5,641,932 A 6/1997 Lace
5,925,839 A 7/1999 Schertler
6,318,497 B1 * 11/2001 De Groot et al. ..... 181/110
6,677,514 B1 * 1/2004 Fishman ..... 84/730
2002/0117047 A1 * 8/2002 Fishman ..... 84/730
2005/0126375 A1 * 6/2005 Hosler ..... 84/726

* cited by examiner

*Primary Examiner*—Marlon Fletcher
(74) *Attorney, Agent, or Firm*—Peter K. Hahn; Luce, Forward, Hamilton & Scripps, LLP

(57) ABSTRACT

Transducer (100, 200, 300, 500, 600) for converting mechanical vibrations to an electrical signal and/or for converting an electrical signal to mechanical vibration. Damping liquid (122, 222, 522, 622) damps the relative vibration of transducer components (110, 250, 252, 254, 510, 610). The damping liquid can be selected to optimize the sound quality of acoustic vibrations at the point of transduction. Also, a transducer with components that rotate relative to each other (304, 310, 504, 510, 604, 610). For example, a permanent magnet component may simultaneous vibrate rotationally and linearly with respect to an electric signal carrying coil. The characteristics of the rotational vibration may be adjusted to optimize sound quality of acoustic vibrations at the point of transduction.

32 Claims, 5 Drawing Sheets

TRANSDUCER FOR CONVERTING BETWEEN MECHANICAL VIBRATION AND ELECTRICAL SIGNAL

FIELD OF THE INVENTION

The present invention is directed to acoustic-magnetic transducers, and more particularly to acoustic-magnetic transducers for use in musical instruments, such as guitars.

BACKGROUND OF THE INVENTION

It has long been recognized that electrical current will induce a magnetic field, and that a moving magnetic field can induce current, or changes in the magnitude of a pre-existing current. One conventional application of this phenomenon is the transducer for converting between current and vibration. More particularly, a transducer for converting between vibration and current can: (1) convert linear mechanical vibration (e.g., acoustic vibration) into a pattern of variations in electrical current; and/or (2) convert variations in a current into vibration. One type of transducer is an accelerometer, which uses the acceleration characteristics of mechanical vibrations in its transduction between vibration and electrical signal.

Generally speaking, the most common geometry for this kind of transducer is a current carrier suspended in proximity to a magnet so that the current carrier and magnet can vibrate relative to each other in a linear direction. If external vibration induces the magnet and the current carrier to move relative to each other, then a current will be induced in the current carrier. If current is supplied to the current carrier from a current source, then the supplied, nominal current is subject to change in magnitude and/or direction by the vibration of the magnetic field. If relative linear vibration of the current carrier and magnet can be induced by external vibrations having a frequency in the acoustic range, then the transducer can be used as a microphone. In a microphone, the current changes in the current carrier may be recorded onto a recording medium or transduced back into acoustic vibrations. Using the current patterns generated by a microphone transducer, sound can be recorded or transmitted across long distances.

Moving to current-to-vibration transduction, an external current source may supply a variable amount of current (e.g., an alternating current) to the current carrier. This will induce the current carrier and the magnet to vibrate relative to each other in a linear direction. If the induced vibration is in the acoustic range, then sound will be produced by the transduction of the current.

Probably the most popular geometry for these transducers is the use of a coil shaped current carrier wrapped around a permanent magnet, with either the coil or the magnet being fixed to some type of housing (e.g., microphone housing, speaker housing). The unfixed component (referred to as the moving component) is partially constrained so that it is free to vibrate in the direction along the central axis of the coil. The moving component or components (depending upon whether both the coil and magnet move) are generally attached to the transducer housing by some type of elastic member that acts as a spring. Also, a diaphragm may be fixed to the moving component to either: (1) better pick up external vibrations from the surroundings (in a microphone); or (2) better transmit induced vibration to the surroundings (in a speaker).

One application for these types of transducers is a geophone for measuring seismic vibrations in the surface of a planet. Another conventional application of the above-discussed type of transducer is the use of the transducer in a guitar. In a guitar, taut strings are vibrated to induce acoustic vibrations in the guitar body and the air surrounding the guitar. A transducer is fixed to some part of the guitar. The vibrations of the guitar induce relative vibration between a coil and a permanent magnet in the transducer. This induced relative vibration causes current patterns in the coil. The current in the coil is usually amplified and sent to a speaker to produce louder and better-directed sound corresponding to the vibration of the guitar.

Examples of transducers for converting between linear vibration and current are shown in the following U.S. Pat. Nos.: (1) 3,725,561 ("Paul"); (2) 4,010,334 ("Demeter"); (3) 4,504,932 ("Sundt"); (4) 4,237,347 ("Burundukov et al."); (5) 5,276,276 ("Gunn"); (6) 5,461,193 ("Schertler"); and (7) 5,641,932 ("Lace"). These patents are herein incorporated by reference. These examples provide some idea of the wide variety of structural details that transducers for converting between current and sound may exhibit.

To the extent that specific publications are discussed above, these discussions should not be taken as an admission that the discussed publications (e.g., patents) are prior art for patent law purposes. For example, some or all of the discussed publications may not be sufficiently early in time and/or sufficiently enabling so as to amount to prior art for patent law purposes.

SUMMARY OF THE INVENTION

One aspect of the present invention involves the use of liquids to damp relative vibration between the magnet (or magnetic member) and the coil carrier in a transducer for converting between vibration and current. As a simple example, the coil and magnet may be suspended in an oil, within an oil-tight transducer housing. Conventional transducers are damped only by surrounding air and perhaps by damping inherent in elastic members that constrain the moving component(s) to the transducer housing. This limited air-and-spring damping limits the amount and quality of the vibrational damping in the transducer.

With the liquid damping aspect of the present invention, the use and careful selection of damping liquids can be used to better control the acoustic characteristics of microphones and speakers employing the transducer. Also, because damping can be supplied as necessary by the damping liquid, there is no need to try to effect damping through any elastic members that constrain the moving component(s) to the housing. In this way, the desired spring force characteristics of the moving component(s) can be adjusted relatively independently of the desired damping.

In the area of acoustic transducers, and especially transducers for picking up vibrations of a guitar, the design flexibility provided by damping liquid and/or rotational vibration can help optimize sound quality characteristics, including characteristics in the following areas: (1) feedback; (2) attack; (3) sustain; (4) equalization; and (5) Dynamic Range. While there are words to describe sound quality characteristics, judgments about what sound quality is ultimately better or worse is necessarily artistic, subjective and context driven. However, by providing more options for variations in sound quality, a greater number of musical artists and listeners will be able to achieve the sound quality that is respectively more optimal for them and their particular acoustic expressions.

According to one aspect of the present invention, a transducer includes a housing, vibrating hardware and damping liquid. The damping liquid is disposed within the housing to at least partially surround the vibrating hardware.

According to a further aspect of the present invention, a transducer includes a housing, an electric signal carrier, carrier connection hardware, a magnetic member, member connection hardware and damping liquid. The electrical signal carrier is disposed at least substantially within the housing, with the electric signal carrier being structured to carry an electrical signal. The carrier connection hardware is structured to physically connect the electrical signal carrier member to the housing. The magnetic member is disposed at least substantially within the housing. The member connection hardware is structured to physically connect the magnetic member to the housing, with the carrier connection hardware and the member connection hardware being structured and located to allow the electrical signal carrier and the magnetic member to vibrate relative to each other. The damping liquid is disposed within the housing to substantially surround at least one of the electrical signal carrier and the magnetic member.

According to a further aspect of the present invention, a method of designing a musical instrument assembly includes several steps. One step is providing a musical instrument structured to output acoustic vibrations. Another step is providing a plurality of transducers, with each transducer respectively comprising mutually vibrating components and damping liquid surrounding at least some of the vibrating components and with at the plurality of transducers having different damping liquids. Another step is using each transducer of the plurality of transducers to transduce the acoustic vibration of the musical instrument into a plurality of respective electrical signals. Another step is reviewing the plurality of electric signals. Another step is selecting an optimal transducer based on the review of the plurality of electric signals.

According to a further aspect of the present invention, a transducer includes a housing, an electric signal carrier, carrier connection hardware, a magnetic member and member connection hardware. The electrical signal carrier is structured to carry an electrical signal. The carrier connection hardware is structured to physically connect the electrical signal carrier member to the housing. The magnetic member is disposed at least substantially within the housing. The member connection hardware is structured to physically connect the magnetic member to the housing. The carrier connection hardware and the member connection hardware are structured and located to allow the electrical signal carrier and the magnetic member to rotationally vibrate relative to each other at least about a rotational axis.

According to a further aspect of the present invention, a method of designing a musical instrument assembly includes several steps. One step is providing a musical instrument structured to output acoustic vibrations. Another step is providing a plurality of transducers, with each transducer. Each transducer includes: (1) an electrical signal carrier structured to carry an electrical signal, and (2) a magnetic member disposed at least substantially within the housing. The electrical signal carrier and magnetic member are structured to be free to vibrate at least rotationally with respect to each other. Another step is using each transducer of the plurality of transducers to transduce the acoustic vibration of the musical instrument into a plurality of respective electrical signals. Another step is reviewing the plurality of electric signals. Another step is selecting an optimal transducer based on the review of the plurality of electric signals.

According to a further aspect of the present invention, a spring includes a first end portion, and a second end portion. The spring is structured so that displacement of the second end portion away from the first end portion in a linear direction along a linear axis will tend to cause the second end portion to rotate with respect to the first end portion about a rotational axis.

DETAILED DESCRIPTION OF THE PREFERRED EMBODIMENTS

Figure 1:
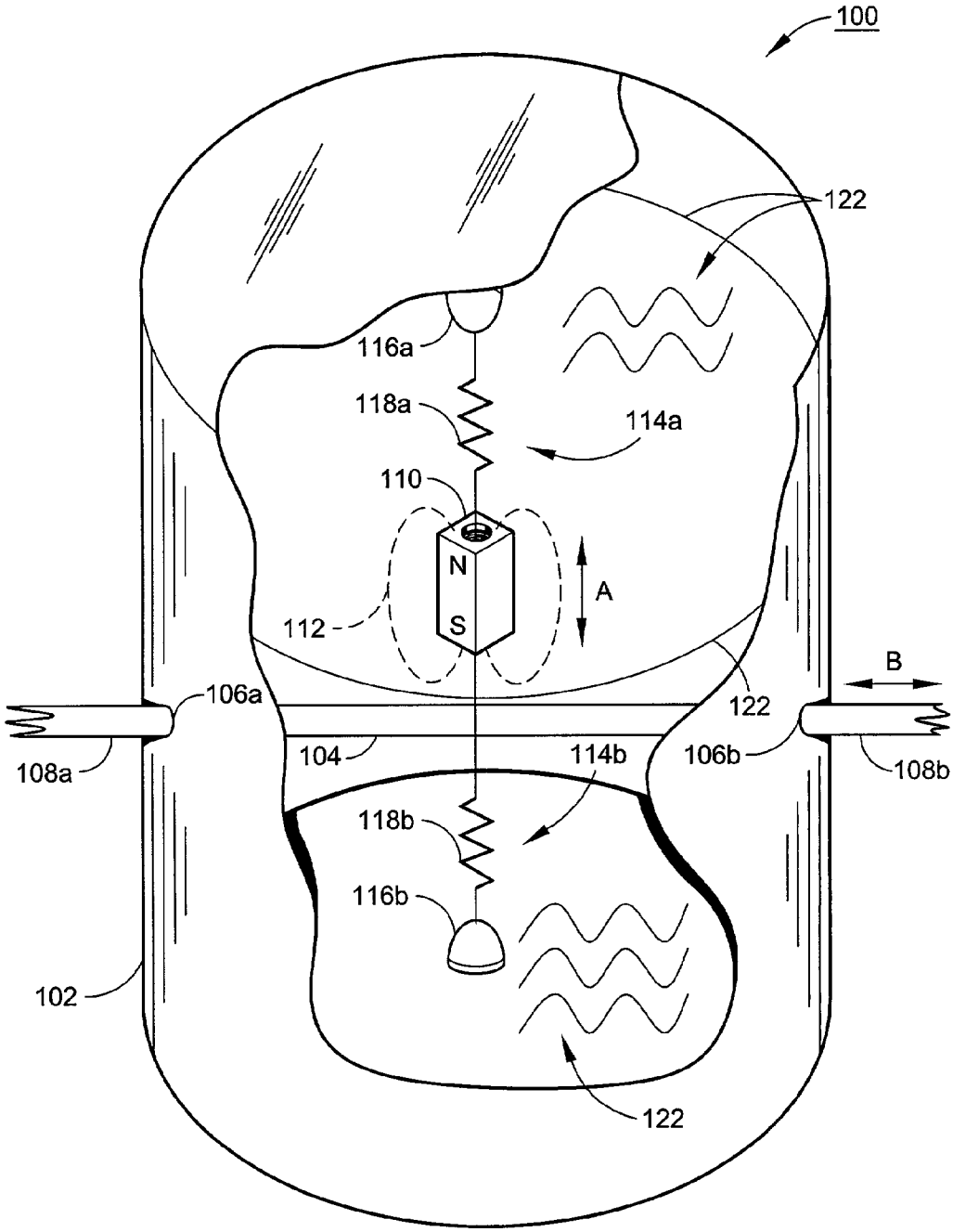
FIG. 1 is a perspective, cutaway view of a first embodiment of a transducer according to the present invention.

Before starting a description of the Figures, instructions for interpreting the words and phrases of this patent document will be provided. More particularly, many jurisdictions allow a patentee to act as its own lexicographer, and thereby allow the patentee to provide instructions in a patent document as to how the words, terms and phrases of the document are to be interpreted as a legal matter. For example, in the United States, the prerogative of the patentee to act as its own lexicographer has been solidly established based on statutory and case law. Accordingly, the following section provides rules for interpreting the words, terms and phrases the claims of this patent document.

Interpretive Rules

Rule 1: There is a "Specially Defined Terms" section set forth below. Only words, terms or phrases that are explicitly defined in the Specially Defined Terms are to be considered to have a special definition, and, of course, the explicit definition provided herein is to serve as the definition for these terms. Accordingly, sources such as the patent specification and extrinsic evidence shall not be used to help define these terms—the explicitly provided definitions shall control.

Rule 2: If a word, term or phrase is not specially defined, then its definition shall be determined in the first instance by resort to dictionaries and technical lexicons that either exist as of the time this patent document is filed. (See definition of "dictionaries and technical lexicons" below in the Specially defined Terms section.) It is acknowledged that dictionaries and technical lexicons often provide alternative definitions. Also, definitions provided in different dictionaries and different lexicons often differ and are not always entirely consistent. In that case, it must be decided which definition is in best accordance with this document. Rules 3 and 4, set forth below, provide some guidelines for choosing between alternative definitions for a word, term or phrase.

Rule 3: The role of the specification (other than the Specially Defined Terms section) as an interpretive or definitional aid shall be limited to helping choose between alternative definitions that meet the requirements of Rule 2 (above). However, the specification will only be useful when the specification is more consistent with one proposed, pre-existing definition than another.

Rule 4: The role of extrinsic evidence (e.g., expert witnesses) as an interpretive of definitional aid shall be limited to helping choose between alternative definitions that meet the requirements of Rule 2 (above). However, the extrinsic evidence will only be useful when the extrinsic evidence is more consistent with one proposed, pre-existing definition than another.

Specially Defined Terms the present invention: means at least some embodiments of the present invention; references to various feature(s) of the "present invention" throughout this document do not mean that all claimed embodiments or methods include the referenced feature(s).

Structured to: this phrase is used in the claims to indicate that some thing X is "structured to" perform some objective Y. This means that X must have appropriate structure to meet the objective Y that occurs after the "structured to" language. It does not mean that the possible structures for X are limited to what is shown in the specification, but rather includes any and all X, now conventional or to be developed in the future, wherein the structure of X allows the X to perform objective Y. (Note that X and Y are used as variables in this definition of "structured to;" in the claims, various things may be recited as the X variable for purposes of applying this definition, and various objectives may be recited as the Y variable.)

comprising . . . a; comprising . . . one; comprising . . . x: comprising means including; for example, if a claim recites that an assembly "comprising a" widget, then the claim should be construed to cover assemblies that have one widget or more than one widget; the fact that the assembly includes a widget does not mean that covered assemblies are limited to one widget unless such a limitation is explicitly present in the claim.

dictionaries and/or technical lexicons: any document whose primary purpose is the definition of words, terms and/or phrases; on the other hand, documents that merely discuss, explain or provide examples of devices or methods, without purporting to provide definitions of specific words, phrases or terms, are not to be considered as dictionaries and/or technical lexicons.

vibrating hardware: any set transducer hardware, now known or to be developed in the future, where portions of the set of hardware vibrate relative to each other in normal use.

electric signal carrier: any hardware, now known or to be developed in the future, that can carry an electric signal, including a electrical voltage signal or an electric current signal. Electric signal carriers include, but are not limited to, electrically conductive wires, coils and members capable of carrying electrical eddy currents.

magnetic member: any member, now known or to be developed in the future, that can effect the geometry of a magnetic field in a transducer. Magnetic members include, but are not limited to permanent magnets, electromagnets and magnetic cores (e.g., ferromagnetic cores). Magnetic members are not required to be unitary, homogenous and/or uniform in construction.

vibrating hardware: hardware that vibrates in any direction or directions, including, but not limited to, linear vibration and rotational vibration and combinations of linear and rotational vibration(s).

connection hardware: any set of hardware, now known or to be developed in the future, for physically constraining components to some degree (e.g., rigid connections, non-rigid connections). Connection hardware includes, but is not limited to spring-like diaphragms, diaphragm springs, helical springs, leaf springs, adhesive connections, friction fits, interference fits, magnetic connections, threaded connections, pivots and combinations of these types of connections.

spring: connection hardware having non-negligible elasticity, including, but not limited to, elastic springs, rotational springs, pneumatic springs, linear springs, non-linear springs, spring-like diaphragms, diaphragm springs, helical springs and leaf springs.

rotational spring: a spring that allows elasticity or displacement in a rotational direction, including, but not limited to, springs that allow rotational vibration in combination with other linear motion (e.g. linear vibration).

audible acoustic signals: acoustic signals having a magnitude and frequency such that they can be heard by the human ear.

microphone characteristics: transducer capable of being driven or actuated by at least some audible acoustic signals.

spring-like diaphragm: a rotational spring having microphone characteristics.

acoustic vibration: mechanical vibrations within a frequency range and of a sufficient energy level to be detected by the average human ear.

reviewing . . . electric signals: any sort of qualitative, quantitative, artistic, aesthetic, functional, objective and/or subjective based judgment made respecting the electric signals, whether made by man, machine or a combination of man and machine. One simple example of reviewing electric signals would be the transduction of the signals into sound so that they could be heard and subjectively judged by a trained human ear. Another example of review would be analysis of the electrical signals magnitude, time and frequency distribution by a piece of computer software written to make judgments about the signal and/or the sound that would result from transduction of the signal into sound. Yet another example of review would be generation of a graphic display of the electric signal so that the graphic display could be judged by a human who is trained to make judgments based on such graphic displays.

liquid: any matter not in a gaseous state, including, but not limited to highly fluid liquids and gels.

acoustic device: a device for receiving or outputting sounds detectable by the human ear. Acoustic devices include, but are not limited to, musical instruments.

To the extent that the definitions provided above are consistent with ordinary, plain and accustomed meanings (as generally evidenced, inter alia, by dictionaries and/or technical lexicons), the above definitions shall be considered supplemental in nature. To the extent that the definitions provided above are inconsistent with ordinary, plain and accustomed meanings (as generally evidenced, inter alia, by dictionaries and/or technical lexicons), the above definitions shall control. If the definitions provided above are broader than the ordinary, plain and accustomed meanings in some aspect, then the above definitions will control at least in relation to their broadening aspects.

Preferred Embodiments

I. Electromagnetic Transducer with Damping Liquid

FIG. 1 shows a transducer 100 according to the present invention that includes housing 102, wire 104, wire aperture 106, leads 108, magnet 110, magnet connection hardware 114 and damping liquid 122. This embodiment is substantially simplified to illustrate the basic concept of using a damping liquid in a transducer. As explained below, electromagnetic interaction between wire 104 and magnet 110 allow transduction between mechanical vibration and an electric signal.

Housing 102 is substantially liquid tight such that it holds damping liquid 122 within its interior space. For clarity of illustration purposes, the damping liquid does not entirely fill housing 122. Preferably, damping liquid 122 would substantially fill housing 122 so that the damping liquid would always surround moving components within the housing, regardless of the orientation of the housing with respect to the gravitational field.

Wire 104 is a simple kind of electric signal carrier. Wire 104 extends through wire apertures 106*a, b* formed in housing 102. The extensions of wire 104 outside of housing 102 are leads 108*a b*. Adhesive or an interference fit rigidly connect wire 104 to the housing at the wire apertures. Alternatively many other types of connection hardware could rigidly connect the wire to the housing. As a further alternative, wire 104 could be constrained to the housing in a less-than-rigid manner so that wire 104 could move with respect to the housing. For example, if magnet 122 were rigidly constrained to the housing, then wire 104 could be connected so that the wire is free to vibrate with respect to the magnet so that transduction could occur though the relative vibration of an electric signal and a magnetic field.

Leads 108*a,b* allow an external electric signal (e.g., current, voltage) to be supplied to wire 104. For example, if transducer 100 were to be used as a speaker, then an alternating current having a magnitude, time distribution and frequency distribution corresponding to an acoustic signal would be supplied to wire 104 via leads 108*a,b*. This current would drive magnet 110 to vibrate, thereby causing sound. Of course, in this example, it would be useful to attach a diaphragm to magnet 110 so that the vibrations would be effectively transferred to the surrounding air.

As a further example, even if magnet 110 were driven to vibrate by external vibrations, an electric signal could be supplied to rigidly-connected wire 104 via leads 108*a,b*. In this case, the vibration would impact the magnitude and/or direction of the resultant electric signal that results from combining the supplied signal with the electricity induced by the electromagnetic interaction of vibrating components. In some transducer embodiments explained below, there will be only one lead from the electric signal carrier because no electric signal is applied to the transducer.

Permanent magnet 110 generates magnetic field 112. Permanent magnet 110 is constrained to housing 102 by magnet connection hardware 114*a,b*. Magnet connection hardware 114*a* includes adhesive 11 6a and helical spring 118*a* (shown schematically for clarity of illustration). Adhesive 116*a* connects spring 118*a* to the housing so that magnet 110 is free to vibrate in a linear direction A with respect to the housing and wire 104. Magnet connection hardware 114*b* is similar to hardware 114*a*, except that it constrains the opposite end of the magnet.

When permanent magnet 110 vibrates in linear direction A, electric current is induced in wire 104 by electromagnetic induction. This phenomenon allows transducer 100 to convert externally-supplied mechanical vibration into an electric signal. On the other hand, when current runs through wire 104, this will tend to cause vibration in the magnet. This phenomenon allows transducer 100 to convert an externally-supplied electric signal into vibration.

As a design alternative, permanent magnet 110 could be formed as a magnetic core, rather than as a permanent magnet having remanent magnetization. In this case, an electric signal would preferably be supplied to the electric signal carrier. The electric signal carrier would induce a voltage, according to Faraday's Law, and magnetic flux. In this case, the magnetic core (e.g., iron, ferromagnetic core) would cause variations in the geometry of magnetic field around the electric signal carrier, which would, in turn, effect the resultant signal in the electric signal carrier. If a magnetic core is used it must have a substantially different magnetic permeability than the atmosphere inside the housing so that the motion of the magnetic core will actually cause significant redistribution of the magnetic field within the housing. For example, if the housing is filled with damping liquid 122, then the magnetic core must have a magnetic permeability that is different than the magnetic permeability of the damping liquid. In magnetic core embodiments, the magnetic core would preferably have a relative magnetic permeability that is much greater than 1.0 and much greater than the surrounding damping liquid.

In transducer 100, the vibrating hardware are wire 104, apertures 106*a,b*, magnet 110 adhesive 116*a,b* and springs 118*a,b*. Because of the structures of these components, magnet 110 will vibrate with respect to the housing, but wire 104 will not. The result is that the magnet and electric signal carrier vibrate relative to each other. As a variation, the connection hardware could be constructed so that the magnetic portion (e.g., permanent magnet, magnetic core) and the electric signal carrier would both vibrate relative to the housing (and relative to each other).

As shown in FIG. 1, damping liquid 122 surrounds permanent magnet 110 and substantially surrounds springs 118*a,b*. This damping liquid damps externally-supplied vibrations that tend to cause permanent magnet 110 to vibrate. The damping liquid will also damp the motion of the magnet and the springs themselves.

For example, the damping fluid will damp vibrations that occur at the: (1) the vibration of the system as a whole (e.g., musical instrument assembly; (2) the resonant frequency for the transducer assembly; and/or (3) the resonant frequency of the vibrating magnet subsystem. By damping vibration at these resonant frequencies, the magnitude of vibration at various resonant frequencies will be limited so that the resonance of the transducer and its independently moving sub-systems does not get out of control and cause mechanical failure or undesirable frequency distributions of the vibrational signal. For systems where the electrical signal of the transducer is amplified and output through a speaker, damping vibration at the resonant frequency of the system can reduce unwanted resonant vibrations caused by vibrational feedback. For transducing the vibrations of musical instruments, one common goal is a flat response that transduces vibrations of frequencies to have equal representation in the electrical output signal.

The degree of damping will depend on the viscosity of the damping liquid. The viscosity of the damping liquid, in turn, will depend on the identity of the damping liquid and also upon temperature. For applications where the transducer is used to transduce external acoustic vibrations from an acoustic guitar, the preferred damping liquid is shock absorber liquid.

Preferably, the damping liquid should not freeze in normal use. Also, if the damping liquid comes into contact with the electric signal carrier (as it does in transducer 100), then the damping liquid should be non-conductive so that the liquid does not short circuit the electric signal carrier. Also, for electromagnetic transducers, the damping liquid must have some magnetic permeability to allow electromagnetic interaction between the electric signal carrier and the magnetic member. Preferably, the damping liquid will not corrode the magnetic member, springs or other hardware into which it comes in contact. Other oils are also preferred as damping because of the range of viscosities and low freezing points of oil-based liquids.

The damping fluid should be chosen to have an optimal viscosity based on the results that are sought. If the transducer is used to transduce acoustic vibrations of a musical instrument, then the damping liquid should be chosen based on the sound that is generated based on the electric signal from the transducer. If the transducer is used as a geophone, then the damping liquid should be chosen to accurately reflect vibrations in the Earth's crust. For transducing external vibrations, damping liquids having low viscosities of 0.5 to 1.0 centipoise will perform differently with respect to sound quality than damping liquids with higher viscosities in the range 1.0 to 100 centipoise.

II. Piezoelectric Transducer with Damping Liquid

Figure 2:
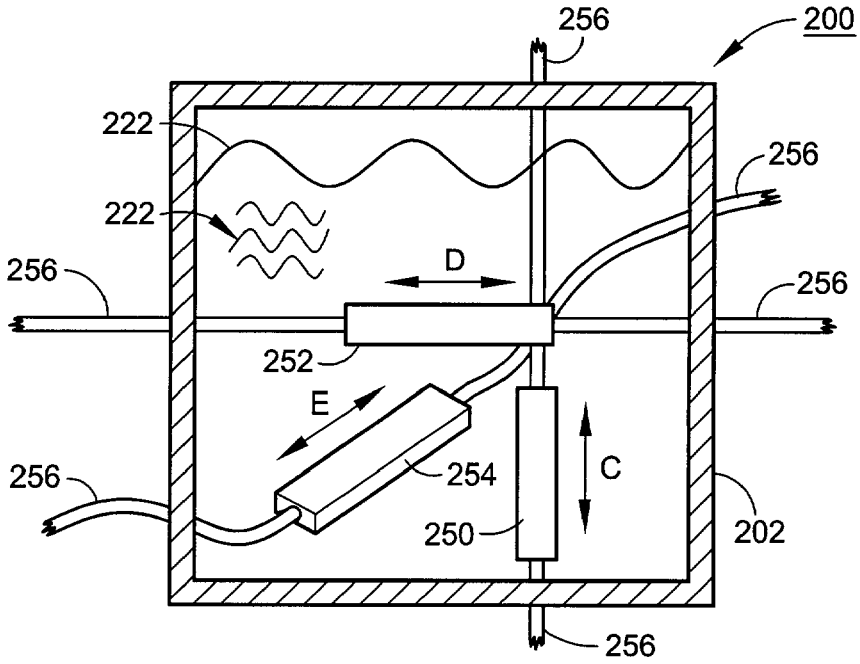
FIG. 2 is a cross-sectional view of a second embodiment of a transducer according to the present invention.

FIG. 2 shows a piezoelectric transducer 200 that includes housing 202, damping liquid 222, piezoelectric element 250, piezoelectric element 252, piezoelectric element 254 and leads 256. The piezoelectric elements 250, 252, 254 vibrate in response to external vibration or in response to an externally-supplied electric signal. When the piezoelectric elements vibrate in response to external vibration, then they will generate electric signals on leads 256 corresponding to the vibrations. On the other hand, if the electric signal is supplied by leads 256, then the vibration of the piezoelectric elements 250, 252, 254 will be induced by the electric signal.

Preferably, the three piezoelectric elements are mutually orthogonal so that: (1) element 250 vibrates along the y-axis in the direction of arrow C; (2) element 252 vibrates along the y-axis in the direction of arrow D; and (3) element 254 vibrates along the z-axis in the direction of arrow C. In this way, transducer 200 an pick up external vibrations regardless of its spatial orientation.

In transducer 200, damping liquid 222 damps external vibrations in the vicinity of piezoelectric elements 250, 254, 256. Transducer 200 illustrates that damping liquid is useful, not only in preferred electromagnetic transducers, but also in any transducer that includes vibrating hardware. The use of damping liquid allows more control over the pattern of external vibrations that are instrumental in any transducer having vibrating hardware.

III. Electromagnetic Transducer with Rotational Vibration

Figure 3:
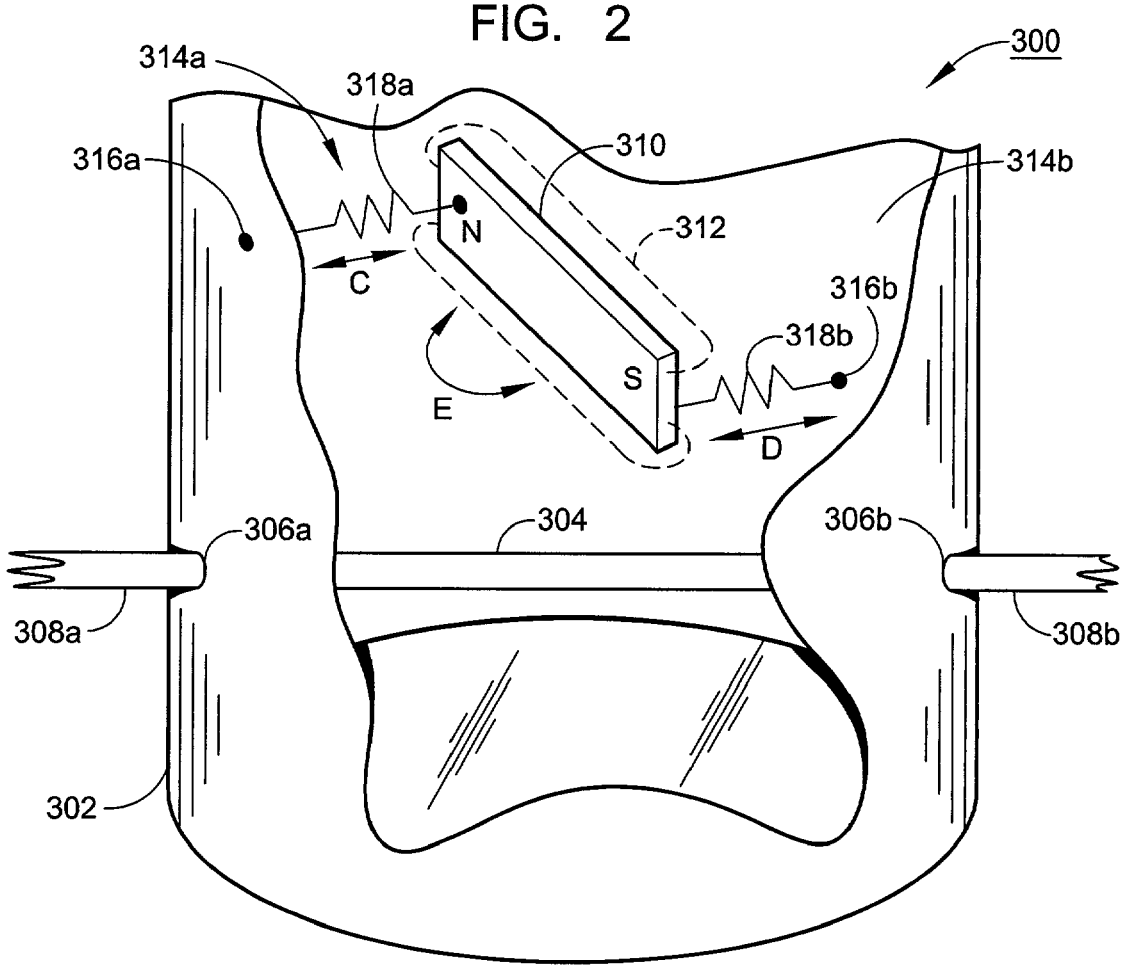
FIG. 3 is a perspective, cutaway view of a third embodiment of a transducer according to the present invention.

As shown in FIG. 3, transducer 300 does not include damping liquid, but it does include hardware for converting linear vibration into rotational vibration and for transducing rotational vibration. This use of rotational vibration is an important feature of at least some embodiments of the present invention. Transducer 300 includes housing 302, wire 304, apertures 306, leads 308, permanent magnet 310, and magnet connection hardware 314.

Housing 302 and, wire 304, apertures 306*a,b* and leads 308*a,b* are generally similar to the corresponding elements in transducer 100, discussed above. It is noted that because there is no damping liquid in this embodiment, it does not matter as much whether housing 302 is liquid tight.

As shown in FIG. 3, magnet connection hardware includes adhesive 316*a,b* and helical springs 318*a,b*. Because of the geometry of springs 318 and permanent magnet 310, external vibrations will tend to cause permanent magnet 310 to rotationally vibrate in the direction of arrow E. This will cause magnetic field 312 to rotate with respect to wire 304 so that an electric signal is induced in wire 304 and leads 308 by the relative motion of the magnetic field. This way, a linear vibration is transduced to an electric signal, but it is transduced in a novel way because the linear vibration is first converted to rotational vibration. This rotational vibration will generally result in a different signal in wire 304 than if the linear vibration were transduced directly.

This rotational vibration can be used in the transduction of acoustic signals to vary the sound quality of a transduced signal in new ways. In transducer 300, only pure rotational vibration in the direction of arrow E is shown. However, vibrating hardware could be constrained so that relative rotational vibration and relative linear vibration are both present. For example, wire 304 could be constrained so that it is free to vibrate in a linear direction with respect to the housing. The resultant signal in wire 304 would correspond to a vector sum of the linear and rotational vibration.

Also, transducer 300 could be used to transduce an electrical signal into rotational vibration of magnet 310. In this case, a variable electric signal would be supplied to wire 304, which would drive magnet 310 to vibrate rotationally due to interaction of its magnet field with the variable current in wire 304.

IV. Spring with Linear and Rotational Displacement

In above-mentioned transducer 300, rotational vibration was used to generate a signal to generate an electrical signal based on the rotational vibration. Now a spring-like diaphragm 400 will be discussed with reference to FIG. 4. This spring-like diaphragm 400 can be economically used to convert linear vibrational motion into a more complex vibrational motion that has both linear and rotational components.

Spring-like diaphragm 400 is a thin disk-shaped spring (see FIGS. 4 and 5) having a central aperture 404 and a set of curved, elongated apertures 402 defined therein. Assume that the outer periphery of the disk 400 is fixed, while the inner periphery can be displaced into and out of the plane of the page in the direction indicated by cross G. When this happens, the inner periphery of disk 400 will rotate (or twist) relative to the fixed outer periphery in the direction indicated by arrow F. This is due to the geometry of the curved, elongated apertures 402. When the spring vibrates in a linear direction, normal to its major surfaces, the inner periphery will also be rotating about the center axis of the disk over some range of angles.

Spring-like diaphragm 400 is preferably made from an elastic and non-magnetic material such that diaphragm exhibits microphone characteristics. Preferably, the spring-like diaphragm 400 has a large Dynamic Range and an approximately linear response. Choosing a non-magnetic material is generally highly preferred since materials that display even a modest amount of relative magnetic permeability tend to distort the natural sound properties. Therefore, in a preferred embodiment of the present invention, diaphragm 400 is made from a material having a relative magnetic permeability of less than 3. The microphone characteristics, Dynamic Range and linearity of the response are largely determined by the geometry (e.g. thickness) and elasticity of spring-like diaphragm 400.

In an exemplary embodiment of the present invention, the spring-like diaphragm 400 is made of Mylar. Mylar is a preferred material for spring-like diaphragm 400 due to its: (1) strength; (2) elasticity; and (3) amenability to microphone characteristics. (It is noted that the name Mylar may be subject to trademark rights.) However, as one of ordinary skill in the art would understand, the spring-like diaphragm 400 may be made from any number of nonmagnetic, elastic materials that exhibit microphone characteristics including, but not limited to, beryllium copper, phosphor bronze and stainless steel.

As will be discussed below in connection with transducer 500, such a spring-like diaphragm can be used to add a rotational vibration in a transducer with vibrating parts. By fixing electric signal carriers and/or magnetic members to the inner periphery of the disk, an externally-supplied linear vibration will be converted into a vibration with both a linear component and a rotational component. However, the spring-like diaphragm 400 may also have applications beyond the world of transducers. Any machine that needs to convert a linear motion (or vibration) to a combination of linear and rotational motion could potentially employ the inventive spring of the present invention.

V. Electromagnetic Transducer with Rotational Vibration and Damping Liquid

Figure 5:
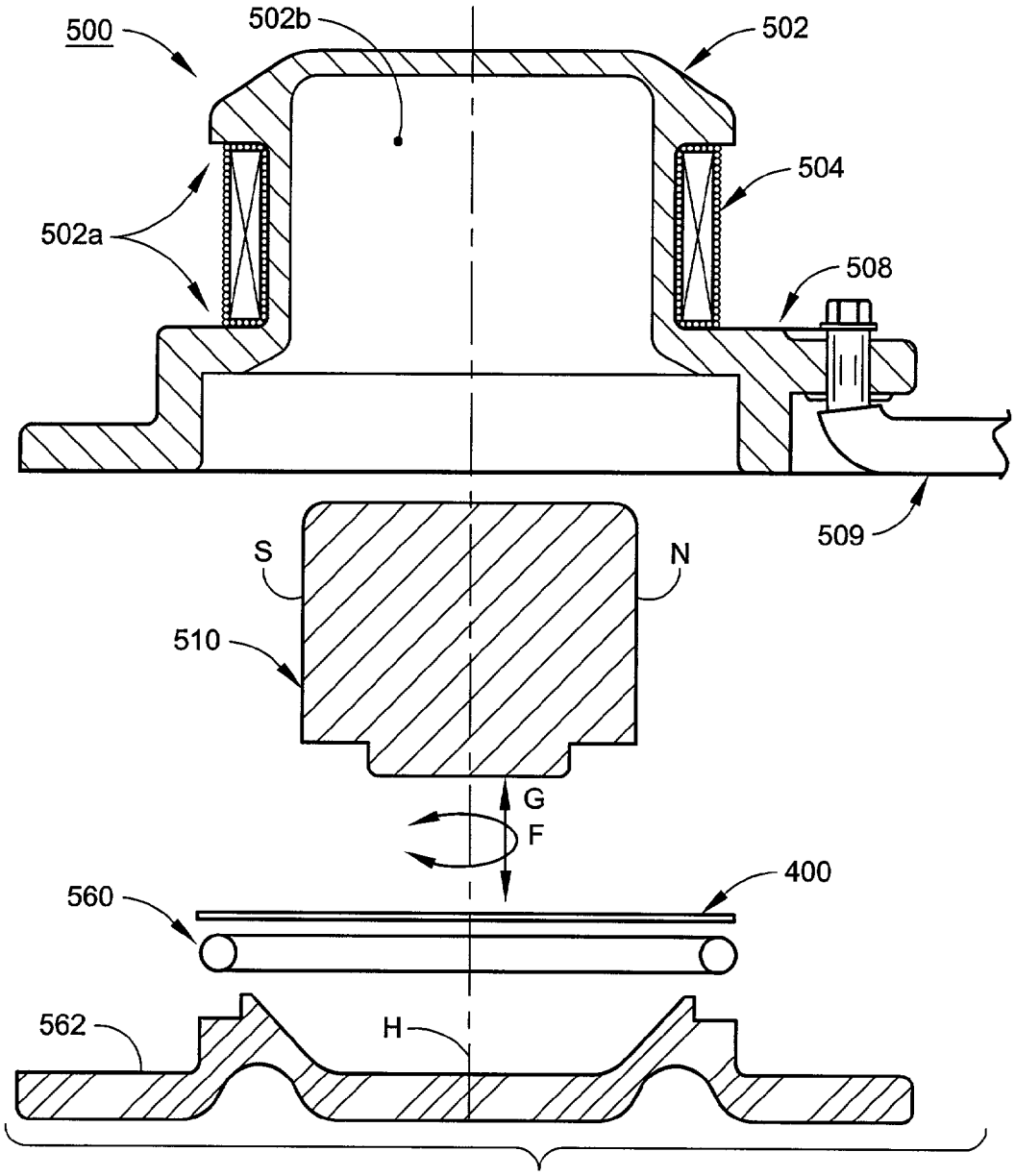
FIG. 5 is an exploded cross-sectional view of a fourth embodiment of a transducer according to the present invention.
Figure 6:
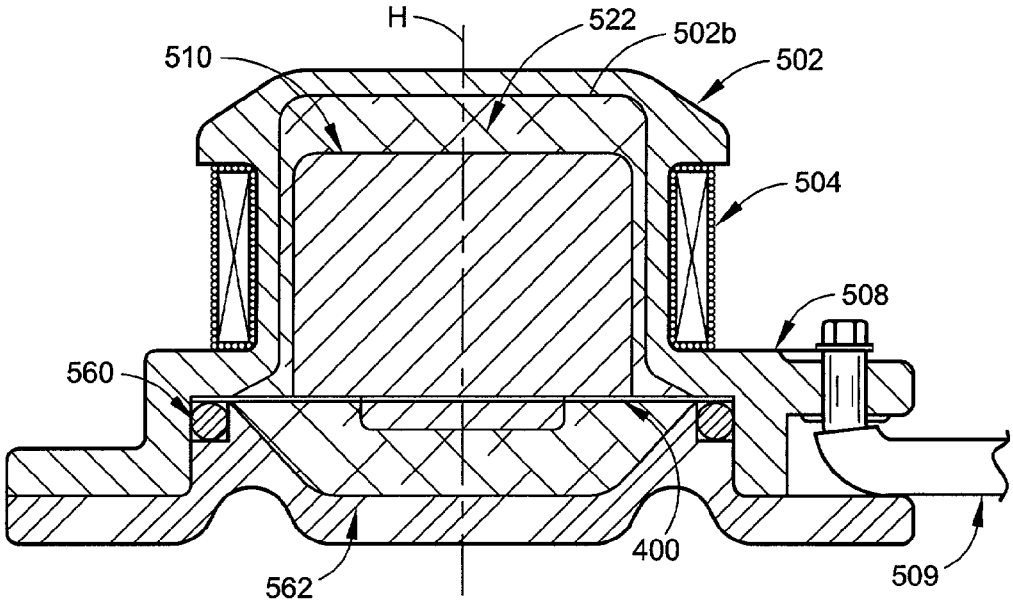
FIG. 6 is a cross-sectional view of the fourth embodiment transducer, showing the fifth embodiment transducer in an assembled state.

A preferred transducer 500 will now be discussed with reference to FIGS. 5 and 6. More particularly, FIG. 5 shows an exploded view of the components of transducer 500, without the damping fluid in place. FIG. 6 shows transducer 500 in its assembled stated with the damping fluid in place. As shown in FIGS. 5 and 6, transducer 500 includes housing 502, coil 504, lead 508, 509, permanent magnet 510, gasket 560, cap 562 and spring-like diaphragm 400.

Housing 502 includes a bobbin portion 502*a* and an interior cavity 502*b*. The bobbin portion is a spool that is the hardware that constrains coil 504 to the housing. The cavity potion 502*b* accommodates vibrating magnet 510. Housing 502 is preferably made of acetyl resin, ABS plastic or Delrin. (It is noted that the name Delrin may be subject to trademark rights.) Preferably, the housing will somewhat damp externally-supplied vibrations. The material selected for housing 502 should provide any necessary damping and shielding, but it should be kept in mind that the need for damping may be limited because of damping liquid 522 (to be further discussed below).

Housing 502 can be constructed to have an additional outer layer (not shown) that encloses 504 and the bobbin portion of housing 502. Such an outer layer is often preferable because it can: (1) protect coil 504; and (2) provide emf shielding for coil 504.

Coil 504 is an electric signal carrier that is coil shaped. It is common to use coil shaped carriers in electromagnetic transducers because this geometry allows a long length of current carrier to be in the greatest proximity to a moving magnetic field (e.g., moving permanent magnet, moving magnetic core) that is centered within the coil. In this embodiment, permanent magnet 510 vibrates relative to housing 502 and coil 504, but the design could be varied so that the coil vibrated relative to the housing in addition to or instead of the magnet. Preferably, for a transducer to be used to transduce the acoustic vibrations of an acoustic guitar, coil 504 has about 1000 windings of 42 gauge copper wire. The number of windings and the wire used to make the coil will vary with the specific application.

As shown by reference characters "N" and "S" in FIG. 5, permanent magnet 510 is cylindrical and is constructed to have one south pole and one north pole disposed symmetrically about the central axis H of the cylindrical magnet. As will now be discussed, this polar orientation of magnet 510 is preferable because it takes good advantage of linear and rotational aspects of the vibration.

Figure 4:
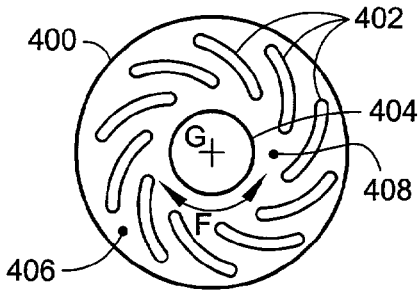
FIG. 4 is an orthogonal view of the top surface of an embodiment of a spring according to the present invention.

More particularly, permanent magnet 510 is fixed to central aperture 404 of spring-like diaphragm 400 (see FIGS. 4 and 6). This means that the magnet will move with the inner periphery 408 of spring-like diaphragm 400 as spring-like diaphragm 400 is driven to vibrate by externally-supplied vibration. As discussed above in connection with FIG. 4, external vibrations will cause the inner periphery of spring-like diaphragm 400 to vibrate linearly in the direction of arrow G and also to vibrate rotationally in the direction of arrow F (arrows F and G are shown in FIG. 5). This means that magnet 510 will also vibrate both linearly and rotationally.

Both the linear and rotational aspects of the vibration of magnet 510 will tend to induce current changes (that is, a type of electrical signal) in coil 504. The strength of the induced electrical signal will correspond with the vector sum of the linear vibration (which is motion substantially normal to the direction of the current in the coil) and the normal component of the rotational vibration. By aligning the poles about central axis H, rather than along the central axis, this vector sum is maximized. This will provide the strongest output electrical signal for a given magnitude of input mechanical vibration.

Lead 508, 509 provides a path for the electric signal (e.g., electrical current) induced in coil 504 to get to external components such as an amplifier and speaker (not shown). While transducer 500 does not include a power supply, a power supply is usually desirable, especially for transducers used to pick up acoustic signals generated by musical instruments, like acoustic guitars.

Permanent magnet 510 may be constructed as a convention permanent magnet. Preferably, developing material technologies, such as bonded neodymium powder magnets, make possible: (1) more powerful magnets; and (2) new magnet geometries. For example, it may be or become possible to make a cylindrical magnet with 2 North poles and 2 South poles alternating about the central axis. It may be possible to make a magnet with even more than 4 total poles distributed in an alternating fashion around the central axis. Such 4 or more pole magnets would be especially useful in conjunction with the rotating vibration aspect of the present invention because these multi-pole magnets would have a more sharply varying magnetic field as taken in the angular direction of the coil. The rotation (that is, angular motion in direction F) of such a cylindrical magnet then sets into motion this magnetic field so that there is more interplay between the coil and the relatively moving magnetic field. The resultant electric signal induced in the coil would tend to be stronger and also would tend to have a different quality than a conventional linear motion transducer.

Damping fluid 522 is put into cavity portion 502*b* of housing 502 when the transducer is assembled. More particularly, the damping fluid and the magnet/spring assembly are inserted into the cavity. Then, gasket 560 and cap 562 are secured over housing 502 and the outer periphery portion 406 of spring-like diaphragm 400. For example, cap 562 can be secured with an adhesive or by an interference fit with housing 502. Gasket 560 is preferably formed as an elastic O-ring. Gasket 560 seals the juncture between cavity 502*b* and cap 560 so that damping fluid does not leak out of transducer 500.

Damping fluid 522 is preferably shock absorber fluid or hydraulic fluid. Preferably the fluid should be at atmospheric pressure. Preferably, the entire cavity 502 should be filled so that there are no air bubbles in the cavity when it is sealed by the cap and gasket.

One advantage of the transducer 500 is its small size (less than an inch around, less than an inch high). The small size is largely the result of the efficiency of converting externally-supplied vibrations to both linear and rotational vibration. The rotational aspect allows more relative motion between the magnetic field and the coil, without substantially increasing the size of the transducer. Because the transducer is so small it will tend to have a good high frequency response, which makes it good for transducing the acoustic vibrations of musical instruments. Also, the small size of the transducer keeps it from being a significant vibrational load even when it is attached to the source of a musical instrument.

VI. Electromagnetic Transducer Housing with Alternative Cap

Figure 7:
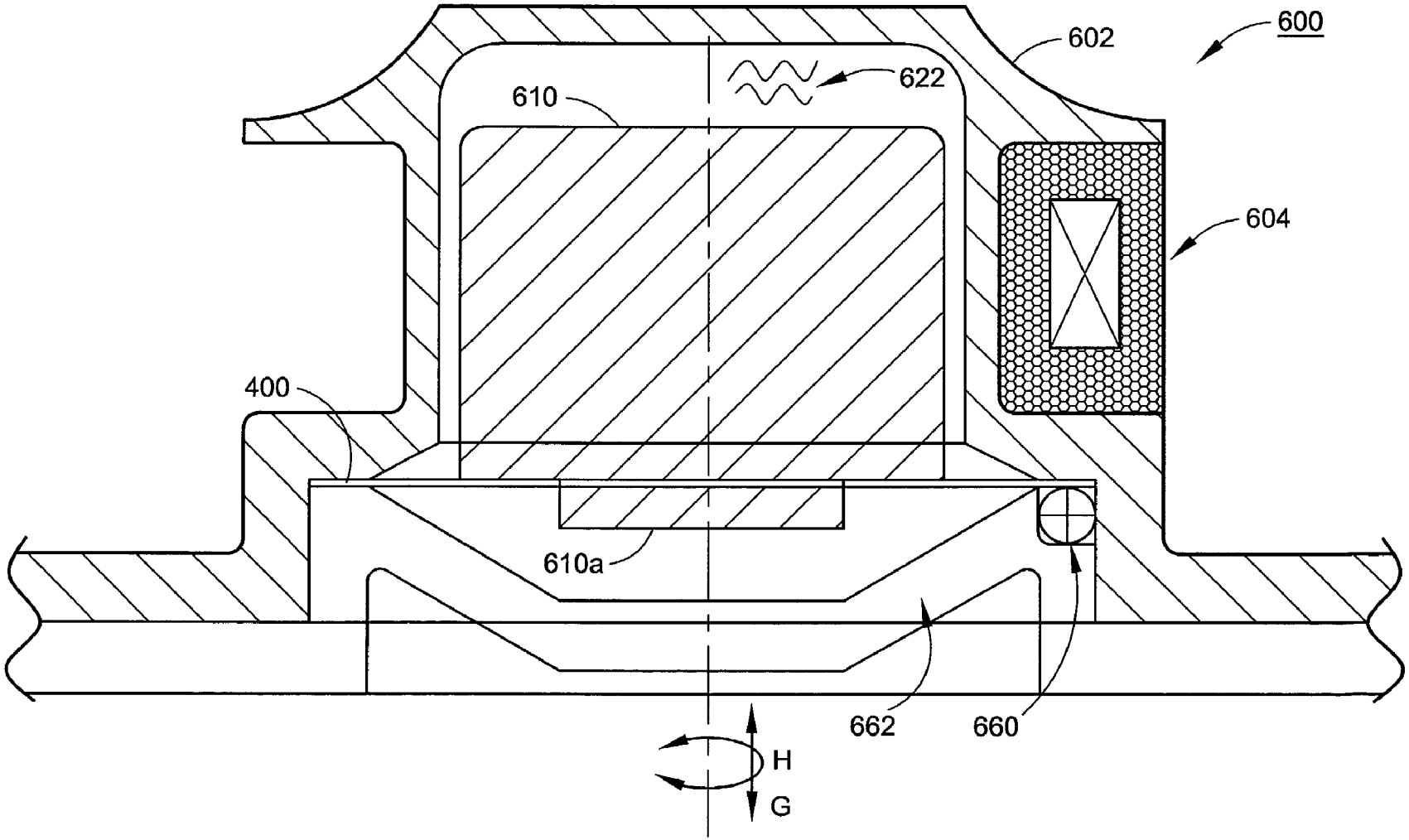
FIG. 7 is a cross-sectional view of a fifth embodiment of a transducer according to the present invention.

FIG. 7 shows transducer 600. Transducer 600 includes housing 602, coil 604, magnet 610, gasket 660 and cap 662. Transducer 600 is similar to previously discussed transducer 500, except that the cross-sectional profile of the cap is a little different. The cap is preferably profiled to provide some space between the cap and the lower surface 610*a* of magnet 610 so that the cap does not interfere with the linear vibration (that is, direction G vibration) of the magnet and spring.

VII. Musical Instrument Assembly Using Transducer

Figure 8:
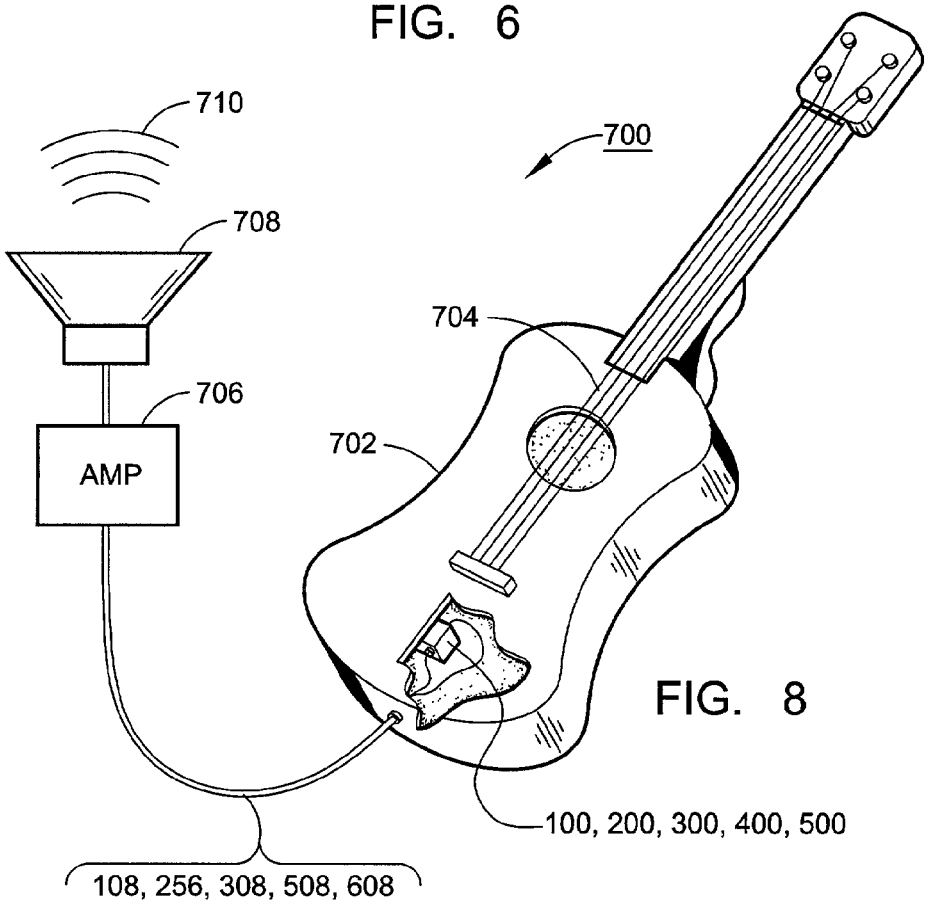
FIG. 8 is a perspective, cutaway view of a first embodiment of a musical instrument assembly according to the present invention.

FIG. 8 shows musical instrument assembly 700. Musical instrument assembly 700 includes acoustic guitar 702, transducer 100, 200, 300, 500, 600, leads 108, 256, 308, 508, 509, amplifier 706 and speaker 708.

As shown in FIG. 8, the transducer (any of the transducers 100, 200, 300, 500, 600 could be selected) is merely attached to a surface of the musical instrument. In this preferred example, the transducer is attached to an inner surface of the sound box of acoustic guitar 702. The transducer is preferably attached by adhesive (not shown). The placement of the transducer on the musical instrument may affect the frequency distribution and/or magnitude of the acoustic vibrations that are received. Therefore, some trial and error may be needed to optimally place the transducer on the acoustic guitar. Alternatively, multiple transducers may be used. Multiple transducers are made more feasible by the small transducer size achievable with the present invention.

Strings 704 of the acoustic guitar are vibrated by plucking or strumming or the like. This causes the entire body of acoustic guitar 702 to vibrate. This vibration will be communicated through the air and through the guitar body to the transducer. As explained above, this externally-supplied vibration may be dampened by the transducer housing and/or by damping liquid. Also, the vibration may be converted, in whole or in part, to a rotational vibration in the transducer.

The electric signal transduced in the transducer is sent by a lead out to amplifier 706. Amplifier 706 is preferably a standard amplifier for amplifying musical instruments based on a signal from a transducer. An amplified signal is then sent to speaker 708 where it is transduced back into sound 710. The transducer that transduces the signal back into sound may or may not employ liquid damping or rotational vibration.

VIII. Method of Choosing Damping Liquid

As explained above, damping liquids of different viscosities will have an effect on the damping of vibrating components of the transducer and its host system (e.g., musical instrument system). Currently, the preferred method for choosing a fluid of optimal viscosity is trial and error. In other words, different transducers with different fluids can be used on the same musical instrument to see which sounds the best to a trained ear (the trained ear should listen to an acoustic signal that is generated based on the electric signal of the transducer).

One goal of the damping is to avoid resonant frequency. Therefore, it may also be possible to have dedicated software analyze the frequency distribution of the electrical output signal to automatically check for resonances, or to display the signal visually so that resonances can be detected in a display by a human observer. Similarly, computers and/or humans can check to see whether the response is flat for a transducer with a damping liquid of some given viscosity.

However, not all characteristics of optimal transducer performance are so easily reduced to simple rules. There may be a significant role for human listeners to listen to different transducers and to judge what will sound better for a given musical audience.

IX. Method of Choosing Rotational Characteristics of Transducer

The sinusoidal, vector sum characteristics of a transducer with rotational motion make it difficult to analytically predict what transducer will perform best for a musical instrument. Springs, like spring 400, can be designed to provide more or less rotational displacement per unit linear displacement. The balance between linear vibration and rotational vibration is a design variable that should be optimized for a given application or audience.

Here, again, different transducers should be tried and their respective output signal should be compared by ear and/or by software, so that the output signal will have the best characteristics (e.g., audio characteristics) for the job at hand.

The description and examples set forth in this specification and associated drawings set forth only preferred embodiment(s) and some of the possible variations of the present invention. The specification and drawings are not intended to limit the exclusionary scope of this patent document. Many designs other than the above-described embodiments will fall within the literal and/or legal scope of the following claims. Because it is generally impossible for a patent to describe in its specification every conceivable and possible future embodiment of the invention, the exclusionary scope of this patent document should not be limited by features: (1) reflected in the specification and drawings, but (2) not explicated or reasonably implicated by the language of the following claims.

What is claimed is:

1. A transducer comprising:

a housing;

an electrical signal carrier physically connected to the housing, with the electric signal carrier being structured to carry an electrical signal;

carrier connection hardware structured to physically connect the electrical signal carrier member to the housing;

a magnetic member physically connected to the housing;

member connection hardware structured to physically connect the magnetic member to the housing, with the carrier connection hardware and the member connection hardware being structured and located to allow the electrical signal carrier and the magnetic member to vibrate relative to each other; and damping liquid disposed within the housing to substantially surround at least one of the electrical signal carrier and the magnetic member;

wherein at least a portion of the electric signal carrier is shaped as a coil, with the coil defining a coil interior and a coil axis, wherein the carrier connection hardware is structured to substantially fix the location of the coil-shaped portion of the electric signal carrier member with respect to the housing, and wherein the member connection hardware is structured to maintain the magnetic member at least partially within the coil interior such that the magnetic member is free to vibrate substantially in the direction of the coil axis.

2. A transducer comprising:

a housing;

an electrical signal carrier physically connected to the housing, with the electric signal carrier being structured to carry an electrical signal;

carrier connection hardware structured to physically connect the electrical signal carrier member to the housing;

a magnetic member physically connected to the housing;

member connection hardware structured to physically connect the magnetic member to the housing, with the carrier connection hardware and the member connection hardware being structured and located to allow the electrical signal carrier and the magnetic member to vibrate relative to each other; and damping liquid disposed within the housing to substantially surround at least one of the electrical signal carrier and the magnetic member, wherein the magnetic member comprises a permanent magnet.

3. The transducer of claim 2 wherein the housing is structured to be sufficiently liquid tight so that no substantial amount of damping liquid can escape from the housing.

4. The transducer of claim 2 wherein the damping liquid is shock absorber liquid.

5. The transducer of claim 2 wherein the damping liquid has a viscosity at 20 degrees Celsius between 0.5 and 1.0 centipoise.

6. The transducer of claim 2 wherein the damping liquid has a viscosity at 20 degrees Celsius between 1.0 and 100 centipoise.

7. The transducer of claim 2 wherein the electric signal carrier member, the magnetic member, the connection hardware and the damping liquid are structured and located so that external vibrations in at least the frequency range of 20 to 20,000 Hertz will induce the electric signal carrier member and the magnetic member to vibrate relative to each other.

8. The transducer of claim 2 further comprising a musical instrument, wherein the electric signal carrier, the magnetic member, the carrier connection hardware, the member connection hardware and the damping liquid are structured and located so that acoustic vibrations of the musical instrument are sufficiently energetic to cause the magnetic member and the electric signal carrier to vibrate relative to each other.

9. The transducer hardware of claim 2 further comprising an amplifier for electrically amplifying the electric signal of the electric signal carrier.

10. The transducer of claim 9 further comprising a speaker for transducing the amplified electric signal into acoustic vibration.

11. The transducer of claim 2 further comprising an electric signal supply structured and located to supply an electric signal to the electric signal carrier, with the magnitude and time distribution of the supplied electric signal being sufficient to drive the electric signal carrier and the magnetic member to vibrate relative to each other.

12. A transducer comprising:

a housing;

an electrical signal carrier physically connected to the housing, with the electric signal carrier being structured to carry an electrical signal;

carrier connection hardware structured to physically connect the electrical signal carrier member to the housing;

a magnetic member physically connected to the housing;

member connection hardware structured to physically connect the magnetic member to the housing, with the carrier connection hardware and the member connection hardware being structured and located to allow the electrical signal carrier and the magnetic member to vibrate relative to each other; and damping liquid disposed within the housing to substantially surround at least one of the electrical signal carrier and the magnetic member, wherein the magnetic member comprises a magnetic core with a relative magnetic permeability greater than 1.0.

13. A transducer comprising:

a housing;

an electrical signal carrier physically connected to the housing, with the electric signal carrier being structured to carry an electrical signal;

carrier connection hardware structured to physically connect the electrical signal carrier member to the housing;

a magnetic member physically connected to the housing;

member connection hardware structured to physically connect the magnetic member to the housing, with the carrier connection hardware and the member connection hardware being structured and located to allow the electrical signal carrier and the magnetic member to vibrate relative to each other; and damping liquid disposed within the housing to substantially surround at least one of the electrical signal carrier and the magnetic member, wherein the member connection hardware comprises a spring assembly structured and located to allow the magnetic member to vibrate in a linear direction relative to the housing along a linear vibration axis and also to allow the magnetic member to vibrate in a rotational direction relative to the housing about a rotational vibration axis.

14. The transducer of claim 13 wherein the spring assembly is structured and located so that the linear vibration axis is at least substantially the same as the rotational vibration axis.

15. The transducer of claim 13 wherein the spring assembly comprises a spring-like diaphragm.

16. A method of designing a musical instrument assembly, the method comprising the steps of:

providing a musical instrument structured to output acoustic vibrations;

providing a plurality of transducers, with each transducer respectively comprising mutually vibrating components and damping liquid surrounding at least some of the vibrating components and with the plurality of transducers having different damping liquids;

using each transducer of the plurality of transducers to transduce the acoustic vibration of the musical instrument into a plurality of respective electrical signals;

reviewing the plurality of electric signals; and selecting an optimal transducer based on the review of the plurality of electric signals.

17. The method of claim 16 further comprising the step of mounting the optimal transducer to the musical instrument.

18. The method of claim 16 wherein the damping liquids have differing viscosities.

19. The method of claim 16 wherein the review of the electric signals comprises the steps of:

transducing the plurality of electrical signals back into output acoustic vibration; and listening to the output acoustic vibration.

20. A transducer comprising:

a housing;

an electrical signal carrier physically connected to the housing, with the electric signal carrier being structured to carry an electrical signal;

carrier connection hardware structured to physically connect the electrical signal carrier member to the housing;

a magnetic member physically connected to the housing;

member connection hardware structured to physically connect the magnetic member to the housing, with the carrier connection hardware and the member connection hardware being structured and located to allow the electrical signal carrier and the magnetic member to rotationally vibrate relative to each other at least about a rotational axis; and damping liquid disposed within the housing to substantially surround at least one of the electric signal carrier and the magnetic member, wherein the carrier connection hardware and the member connection hardware are structured and located to allow the electrical signal carrier and the magnetic member to rotationally and linearly vibrate relative to each other at least along a linear axis, wherein at least a portion of the electric signal carrier is shaped as a coil, with the coil defining a coil interior and a coil axis, and wherein the carrier connection hardware and the member connection hardware are structured and located so that the rotation axis is substantially the same as the coil axis.

21. The transducer of claim 20 wherein the carrier connection hardware and the member connection hardware are structured and located so that:

the only substantial rotational vibration between the electric signal carrier and the magnetic member is the rotational vibration about the rotational axis; and the only substantial linear vibration between the electric signal carrier and the magnetic member is the linear vibration along the linear axis.

22. The transducer of claim 21 wherein the rotational axis is substantially the same as the linear axis.

23. The transducer of claim 20 wherein the carrier connection hardware and the member connection hardware are structured and located to allow relative linear vibration of the electric signal carrier and the magnetic member along the coil axis.

24. The transducer of claim 20 further comprising an amplifier for electrically amplifying the electric signal of the electric signal carrier.

25. The transducer of claim 24 further comprising a speaker for transducing the amplified electric signal into acoustic vibration.

26. The transducer of claim 20 further comprising an electric signal supply structured and located to supply an electric signal to the electric signal carrier, with the magnitude and time distribution of the supplied electric signal being sufficient to drive the electric signal carrier and the magnetic member to vibrate relative to each other.

27. A transducer comprising:

a housing;

an electrical signal carrier physically connected to the housing, with the electric signal carrier being structured to carry an electrical signal;

carrier connection hardware structured to physically connect the electrical signal carrier member to the housing;

a magnetic member physically connected to the housing;

member connection hardware structured to physically connect the magnetic member to the housing, with the carrier connection hardware and the member connection hardware being structured and located to allow the electrical signal carrier and the magnetic member to rotationally vibrate relative to each other at least about a rotational axis; and damping liquid disposed within the housing to substantially surround at least one of the electric signal carrier and the magnetic member, wherein the carrier connection hardware and the member connection hardware are structured and located to allow the electrical signal carrier and the magnetic member to rotationally and linearly vibrate relative to each other at least along a linear axis, and wherein the spring assembly comprises a spring-like diaphragm with at least one aperture defined therein, with the spring-like diaphragm and aperture being shaped to cause rotational motion within the spring-like diaphragm when the spring-like diaphragm vibrates.

28. The transducer of claim 27 wherein the spring-like diaphragm is made from a material having an elasticity that is equal to or greater than that of Mylar.

29. The transducer of claim 27 wherein the diaphragm is made from a material having a relative magnetic permeability of less than 3.

30. The transducer of claim 27, wherein the diaphragm exhibits microphone characteristics.

31. The transducer of claim 27, wherein the diaphragm is made from Mylar.

32. The transducer of claim 27 wherein:

the spring-like diaphragm is substantially disk shaped; and the spring aperture defines a plurality of curved, elongated apertures.

* * * * *